US012735903B2

(12) United States Patent
Bennett et al.

(10) Patent No.: US 12,735,903 B2
(45) Date of Patent: Sep. 15, 2026

(54) INSULATING MODULAR PANEL CONFIGURATION

(71) Applicants: Rodger Bennett, Newport News, VA (US); Celeste Vaughn, Newport News, VA (US)

(72) Inventors: Rodger Bennett, Newport News, VA (US); Celeste Vaughn, Newport News, VA (US)

( * ) Notice: Subject to any disclaimer, the term of this patent is extended or adjusted under 35 U.S.C. 154(b) by 359 days.

(21) Appl. No.: 16/899,582

(22) Filed: Jun. 12, 2020

(65) Prior Publication Data

US 2020/0392743 A1 Dec. 17, 2020

Related U.S. Application Data

(60) Provisional application No. 62/860,491, filed on Jun. 12, 2019.

(51) Int. Cl.

| | |
|---|---|
| ***E04B 5/48*** | (2006.01) |
| ***E04F 15/18*** | (2006.01) |
| *E04F 13/02* | (2006.01) |
| *E04F 15/02* | (2006.01) |
| *E04F 15/08* | (2006.01) |

(52) U.S. Cl.

CPC ..... *E04F 15/185* (2013.01); *E04B 5/48* (2013.01); *E04F 13/02* (2013.01); *E04F 15/02194* (2013.01); *E04F 15/082* (2013.01); *E04F 15/182* (2013.01)

(58) Field of Classification Search

CPC ..... F24D 13/02; F24D 3/142; E04F 15/182; E04F 15/185; E04F 2203/04; E04F 15/18; E04F 2290/023; E04F 15/022; E04F 15/02194; E04F 15/082; E04B 5/48; Y02B 30/00

See application file for complete search history.

(56) References Cited

U.S. PATENT DOCUMENTS 2,512,310 A * 6/1950 Corson ..... A47G 27/0231 D6/583

2,899,708 A 8/1959 Donaldson et al.

(Continued)

FOREIGN PATENT DOCUMENTS

CA 2792370 A1 4/2014
CA 2886343 A1 9/2015

(Continued)

OTHER PUBLICATIONS

Printout Google Patent EP1332318A1 (Modular Panel for Laying in Underfloor and Wall Heating Systems and Thermoconductive Sheets for the Same), 2001, https://patents.google.com/patent/EP1332318A1/en?oq=EP1332318A1.

(Continued)

*Primary Examiner* — Phi D A
*Assistant Examiner* — Phi D Tran

(57) ABSTRACT

Method and manufacture for implementing an insulating modular panel designed to assist a user with installing a transfer element across an installation surface. The transfer element may be used to provide heating or cooling. The panels may incorporate a plurality of apertures. The modular configuration of the panels provides the user with easy, fast, and efficient installation across a variety of surfaces.

18 Claims, 13 Drawing Sheets

(56) References Cited

U.S. PATENT DOCUMENTS 3,699,926 A * 10/1972 Stockl ..... A01K 1/0157 206/0.8
4,250,674 A * 2/1981 Feist ..... E04B 5/48 D25/138
4,287,693 A * 9/1981 Collette ..... B32B 3/06 52/302.1
4,318,258 A 3/1982 Heck
4,326,366 A * 4/1982 Werner ..... F24D 3/142 52/789.1
D265,257 S * 6/1982 Bunger ..... D30/120
4,546,024 A 10/1985 Brown
4,640,067 A * 2/1987 Hagemann ..... F24D 3/142 52/220.3
4,640,854 A * 2/1987 Radtke ..... E04F 15/185 428/179
4,698,249 A 10/1987 Brown
4,727,697 A * 3/1988 Vaux ..... E04F 15/22 428/116
4,835,034 A 5/1989 Cruz
4,948,116 A * 8/1990 Vaux ..... E01C 13/065 428/17
5,030,502 A 7/1991 Teare
5,104,715 A 4/1992 Cruz
5,205,091 A 4/1993 Brown
6,035,591 A 3/2000 Hicks
6,094,878 A * 8/2000 Schluter ..... F24D 3/142 52/480
6,161,353 A 12/2000 Negola
6,188,839 B1 2/2001 Pennella
6,539,643 B1 4/2003 Gleeson
6,539,681 B1 * 4/2003 Siegmund ..... E04F 15/02429 405/38
6,926,077 B2 * 8/2005 Kuga ..... F24D 3/16 165/172
7,013,609 B2 * 3/2006 Hydock ..... F24D 3/142 52/220.1
D541,396 S * 4/2007 Fawcett ..... D23/314
7,325,325 B2 2/2008 Gleeson
7,536,835 B2 5/2009 Schluter
7,651,757 B2 1/2010 Jones et al.
7,832,159 B1 11/2010 Kayhart
7,849,642 B2 * 12/2010 Forster ..... E01C 9/086 52/180
7,891,149 B2 2/2011 Turner
8,020,783 B2 9/2011 Backman, Jr.
D654,600 S 2/2012 Devine et al.
8,176,694 B2 5/2012 Batori
8,288,689 B1 * 10/2012 Adelman ..... H05B 3/34 219/241
D672,028 S 12/2012 MacPhee
8,407,951 B2 * 4/2013 Haney ..... E01C 5/20 52/180
8,505,256 B2 * 8/2013 Cerny ..... E04F 15/10 52/263
8,844,227 B1 9/2014 Ciuperca
8,881,476 B2 11/2014 Sullivan et al.
8,881,482 B2 * 11/2014 Cerny ..... E01C 13/045 52/126.5
9,010,060 B2 4/2015 Rapaz
9,188,348 B2 * 11/2015 Larson ..... E04B 5/48
9,228,749 B2 1/2016 Morand et al.
9,328,520 B1 5/2016 Kriser
9,428,920 B2 * 8/2016 Schluter ..... E04F 13/0885
9,476,166 B2 10/2016 Hydock
9,625,163 B2 * 4/2017 Larson ..... E04B 5/48
9,719,265 B2 * 8/2017 Bordin ..... F24D 3/141
9,726,383 B1 * 8/2017 Bordin ..... F24D 3/142
9,777,931 B2 10/2017 Larson
D806,276 S 12/2017 Bordin
9,890,959 B2 2/2018 Houle et al.
D818,615 S 5/2018 Bordin
10,072,852 B2 9/2018 Fuhrman
D830,584 S 10/2018 Comitale et al.
10,100,517 B2 * 10/2018 Liang ..... F24D 3/142
10,190,324 B2 1/2019 Julton et al.
10,215,423 B2 * 2/2019 Bordin ..... F24D 13/02
D857,244 S 8/2019 Faotto et al.
D857,933 S 8/2019 Julton et al.
10,392,814 B2 8/2019 Schluter
D874,687 S 2/2020 Schluter
10,701,764 B2 * 6/2020 Bench ..... H05B 3/56
10,712,020 B2 7/2020 Larson
10,859,274 B2 * 12/2020 Bordin ..... F24D 3/141
11,490,462 B2 11/2022 Rundle
11,499,272 B2 * 11/2022 Conrad ..... B29C 37/0032
11,725,399 B1 8/2023 Sennik
2004/0043682 A1 3/2004 Taylor
2005/0064145 A1 3/2005 Hoie et al.
2006/0096208 A1 5/2006 Turner
2007/0289238 A1 12/2007 Payne
2009/0026192 A1 * 1/2009 Fuhrman ..... H05B 3/56 52/220.1
2014/0069039 A1 3/2014 Schluter
2014/0097169 A1 4/2014 Charron
2015/0276235 A1 10/2015 Fuhrman
2016/0192443 A1 6/2016 Schluter
2016/0273232 A1 9/2016 Bordin
2017/0284108 A1 10/2017 Larson
2018/0017269 A1 1/2018 Houle et al.
2018/0051892 A1 2/2018 Bordin
2018/0223543 A1 8/2018 Faotto
2018/0299140 A1 10/2018 Larson
2020/0191413 A1 6/2020 Faotto
2020/0392743 A1 12/2020 Bennett et al.

FOREIGN PATENT DOCUMENTS

CA 3140116 A1 12/2020
CN 1429305 A 3/2001
CN 101107479 A 6/2004
CN 101180502 B 1/2012
CN 102587515 A 7/2012
CN 210035658 U 2/2020
CN 108027147 B 5/2020
CZ 20023163 A3 3/2001
DE 10054880 B4 11/2005
DE 202016106443 U1 * 3/2018 ..... F24D 3/142
EP 0854325 A2 7/1998
EP 0999415 A2 10/2000
EP 0746727 B1 8/2002
EP 2239512 B1 4/2016
EP 2148965 B1 10/2016
EP 3183505 B1 4/2019
EP 3983620 A1 4/2022
EP 3805649 B1 5/2024
ES 3040892 T3 11/2025
GB 2383057 A 6/2003
GB 2444241 A 6/2008
GB 2460420 A 12/2009
HU P0300536 A2 7/2003
IT 102015000041246 3/2017
JP 3112429 U 8/2005
JP 2005299985 A 10/2005
JP 3810317 B2 8/2006
JP 2006250526 A 9/2006
JP 3143337 U 7/2008
JP 4803120 B2 10/2011
JP 4871053 B2 2/2012
JP 201462672 A 4/2014
JP 2025100413 A 7/2025
KR 100651184 B1 11/2006
KR 1020140037701 A 3/2014
KR 1020140063172 A 5/2014
KR 1020150056427 A 5/2015
NL 1033859 C2 1/2009
WO WO2002/37032 A1 5/2002
WO WO2007/111418 A1 10/2007

(56) References Cited

FOREIGN PATENT DOCUMENTS

| | | |
|---|---|---|
| WO | US2020/037334 | 6/2020 |
| WO | WO2020/252219 A1 | 12/2020 |

OTHER PUBLICATIONS

Printout Google Patent ES3040892T3 (Insulating Modular Panel Configuration), Bennett et al., 2020, https://patents.google.com/patent/ES3040892T3/en?oq=es3040892.
Printout Google Patent GB0007000D0 (Composite Building Components), 2000, https://patents.google.com/patent/GB0007000D0/en?oq=gb0007000.
Printout of Google Patent IT1393538B1 (Modular Prefabricated Radiant Panel with Built-in Collectors), 2009, https://patents.google.com/patent/IT1393538B1/en?oq=it1393538.
Printout Google Patent JP2003194351A (Floor Heating Panel), 2001, https://patents.google.com/patent/JP2003194351A/en?oq=jp2003194351.
Canadian Intellectual Property Office, Documents Cited CVRB10001 CA OA_1_Refs, Application No. 31140116, Bennett et al., Dec. 17, 2025, and response dated Apr. 9, 2026.
European Patent Office, Extended European Search, May 30, 2023, Ref: SCB3667EUR, App: 20822087.1-1016/3983620, Bennett et al.
European Patent Office, OA Sep. 8, 2024, Ref: SCB3667EUR, App. 20822087.1-1015, Bennett et al.
PCT Search Report, PCT/US2020/37334, Bennett et al., Jun. 12, 2020.
Italian Patent Office, Document No. 102009901717704, Sep. 27, 2010.

* cited by examiner

INSULATING MODULAR PANEL CONFIGURATION

CROSS-REFERENCE TO RELATED APPLICATIONS

This application claims the benefit of U.S. Provisional Application No. 62/860,491, filed Jun. 12, 2019, which is hereby incorporated by reference in its entirety.

BACKGROUND

Technical Field

The present application relates to an insulating modular panel which may be installed on an installation surface to provide certain functionality therefore. The modular aspect of the panel configuration greatly facilitates manufacturing, design, use and installation, transport, and storage. Moreover, it reduces installation errors. The panels may provide for efficient and fast installation of energy transfer elements between an installation surface and a top layer.

Description of Related Art

In construction and industrial applications, often surfaces are insulated to prevent or reduce heat waste. Heat waste is inefficient, expensive, and contravenes environmental goals associated with reduced power consumption or fuel emissions.

Additionally, certain improvements have been made to the manner of heating or cooling surfaces which are considered desirable. In some applications, heating or cooling is applied at the installation surface. For example, in flooring applications, heating elements may be installed below the surface of the finished floor and above the subfloor to heat the finished floor. Alternatively, surfaces may be refrigerated or cooled.

Each of these insulating and energy transfer applications includes inefficiencies which seriously limit their use and desirability. For example, hydronic or water tubes which transfer energy have minimum bend radii which makes them complicated to install. Electrical wires laid for floor heating under tile floors are hard to install and complicated to dimension out. These are but two of a myriad of difficulties plaguing these types of applications. In particular, all of these applications require a lot of planning and calculating to determine how much of each installation component is required and how it should be laid out to provide an appropriate installation. This time consuming and complicated design and planning phase not only deters use, but also increases the chances for mistakes. In general these projects are hard to implement, are costly, and inefficient. Mistakes in installation are difficult to rectify.

A need exists to provide a manufacture and a method to easily and quickly install insulating panels which transfer energy from one surface to another on installation surfaces which are sufficiently flexible to adapt to a wide variety of project types and sizes without the need for complicated planning or calculating.

SUMMARY

The present application provides an efficient, fast, easy, and cost effective method to apply panels to an installation surface to direct energy transfer and provides a product to accomplish the same. The present application provides these benefits in part by providing a modular system in which the panels are predesigned with the needs of the installation in mind. By being predesigned as such, the planning and calculations required for the installations are largely predetermined. That is, predesigned panels which comprise the modular configuration creates uniformity which simplifies installation and reduces installation error. Moreover, the design of the panels predetermines many of the calculations or decision points necessary to affect the design; thereby reducing a seemingly infinite number of decisions points to a few. This fewer number of decision points increases efficiency in installation and reduces installation error. By way of example, without predesigned panels, an installer may layout wiring for floor heating in an effectively infinite number of paths on the installation surface. If those paths are predetermined by the design of the panels, then the installer follows the predetermined paths and thus may correctly lay out the wires in an optimal layout without having to design or calculate that layout. Therefore, the panels function as templates which guide the installer and reduce installation error.

Additionally, in some embodiments, the design of the panels may include standardized layouts for the transfer elements. In this way, not only is installation facilitated and on-site design eliminated, but the layouts can be standardized.

In some embodiments, channels may be incorporated which receive the transfer element and will determine the placement and routing of it. In these embodiments too, even though the transfer element is incorporated onsite, the configuration of the panels affords the benefits mentioned above and limits time-consuming design and calculation onsite.

In one embodiment, the insulating modular panel configuration includes at least one panel with a top surface, a bottom surface for coupling to an installation surface, at least one channel configured to receive a transfer element to transfer energy, and the panel is installed across an installation surface. Moreover, the composition of the panel is selected to provide thermal insulation between the installation surface and the top surface of the panel, and wherein the panel is configured for installation on the installation surface as part of a modular system.

In one embodiment, the panel is made of a material having a density between 0.5 and 6 lbs. per cubic feet. In one embodiment, the panel is made from a foamed material. The foamed material may be expanded polystyrene foam. In one embodiment the configuration further includes apertures. The apertures are filled in one embodiment. They include tapered walls in another embodiment. In one embodiment, the configuration includes a plurality of channels. In some embodiments, the channels are spaced 3 inches or 6 inches or 12 inches on center. In yet other embodiments, the bottom surface further comprises at least one protrusion or at least one depression. In one embodiment, the installation surface is a subfloor.

In one embodiment, the configuration includes at least one panel with a top surface, a bottom surface for coupling to an installation surface, a plurality of apertures configured to receive a filler material, and panel is installed across an installation surface. Moreover, the composition of the panel is selected to provide thermal insulation between the installation surface and a top surface of the panel, and the panel is configured for installation on the installation surface as part of a modular system.

In one embodiment, a method is provided wherein at least one panel is provided; wherein the panel includes a top surface, a bottom surface for coupling to an installation surface, and a channel configured to receive a transfer element adapted for transporting energy. The method includes coupling the panel to the installation surface. The method further includes providing a second panel having a channel and coupling the second panel to the installation surface. The method further includes placing one or more of the transfer element within the channels, wherein the composition of a panel is selected to provide thermal insulation between the installation surface and the top surface of the panel, and wherein the panel is configured for installation on the installation surface as part of a modular system.

In another embodiment, a method is provided including the steps of providing at least one panel with a top surface, a bottom surface for coupling to an installation surface, and a plurality of apertures. The method further includes coupling the panel to the installation surface. The method further includes providing a second panel having apertures and coupling said second panel to said installation surface. The method further includes filling the apertures with a filler, wherein the composition of a panel is selected to provide thermal insulation between the installation surface and the top surface of the panel, and wherein the panel is configured for installation on the installation surface as part of a modular system.

In yet another embodiment, a method of using first and second panels is provided wherein the first panel includes a top surface, a bottom surface for coupling to an installation surface, and a channel configured to receive a transfer element adapted for transferring energy. The method further includes coupling the first panel to the installation surface. The method further includes providing a second panel having a channel and coupling the second panel to the installation surface. The method further includes placing one or more of the transfer elements within the channels of the first panel and the second panel, wherein the composition of the first and second panels is selected to provide thermal insulation between the installation surface and the top surface of said first and second panels.

DETAILED DESCRIPTION

Figure 1:
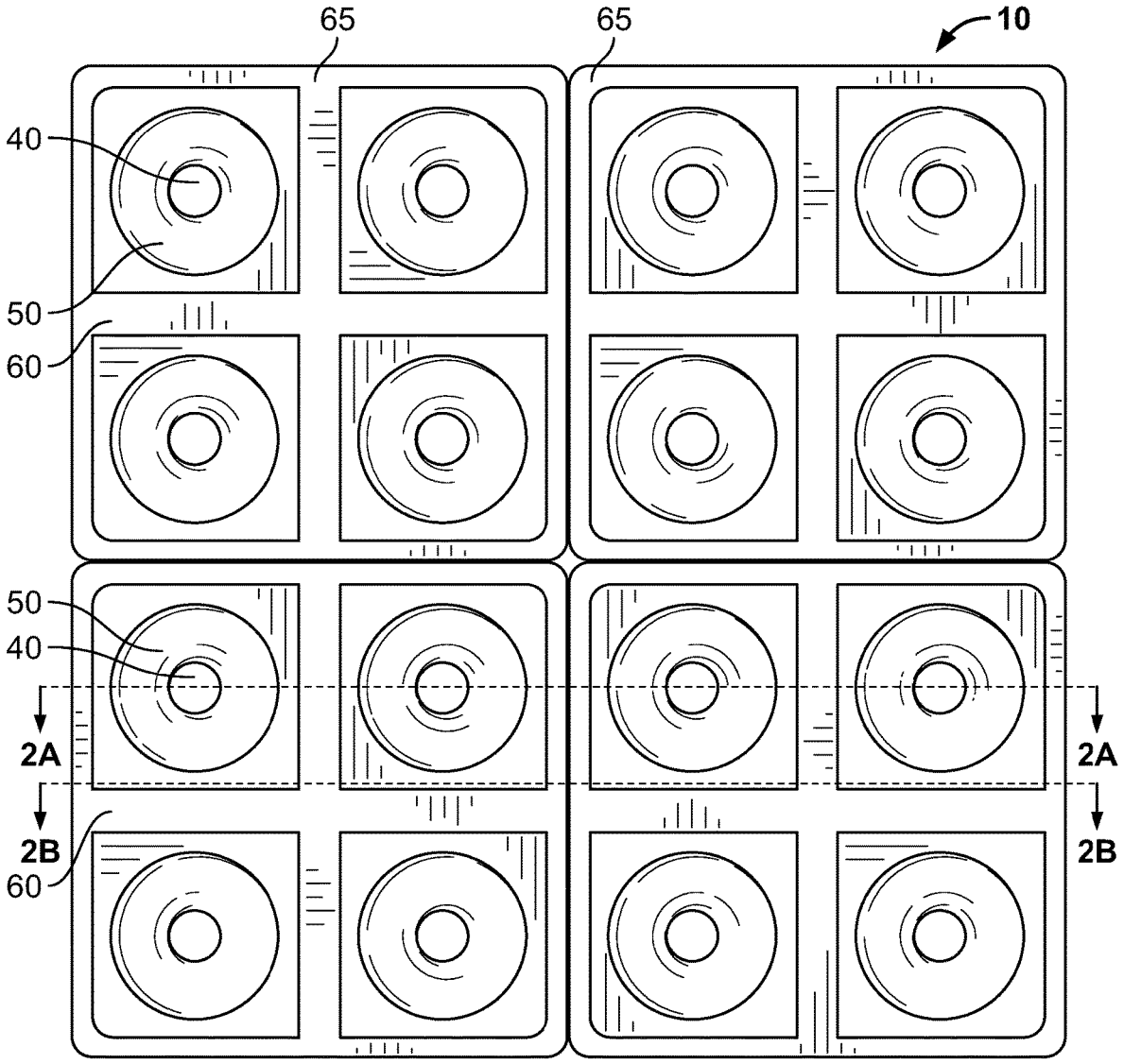
FIG. 1 depicts the top surface of an embodiment of an insulating modular panel.

In the following detailed description, numerous specific details are set forth by way of examples in order to provide a thorough understanding of the relevant teachings of this application. It should be noted, however, that the present teachings may be practiced without such details. In other instances, known methods, procedures and components have been described at a relatively high level, without detail, in order to avoid unnecessarily obscuring aspects of the teachings.

The insulating modular panel configuration of the present application is a panel structure, comprising one or more panels, that assists a user with the installation of insulation panels on a surface. The panel (hereinafter generally described with respect to one of the panels in the modular configuration) may be configured to receive one or more energy transfer elements, for example for heat transfer or for cooling. Such element may include wires or hydronic tubes. A panel may be configured to receive the transfer elements and the transfer elements may be incorporated into the panel onsite. Alternatively, the panel may be preconfigured with the transfer elements already incorporated therein. A panel may include more than one type of transfer elements for transferring energy.

The insulating modular panel enables a user to more easily install the modular configuration without time-consuming or complicated planning and design and without the need for excessive computation of the amounts of components needed. The modular configuration is comprised of panels which are predesigned and placed on the installation surface, and in so functioning, simplify installation. Moreover, the preformed panels include features configured to receive the transfer elements. Because the transfer element layout is predetermined in the panel, the need for onsite planning and design to determine the layout and calculations to determine the lengths of transfer elements required for the installation are mostly eliminated. Elimination of this need for design and computation not only reduces time, but also greatly reduces installation errors. Jobsite and installation errors are costly and are often very difficult to correct. By simplifying the installation process, time and money is saved and installation error is largely decreased. The present panels enable a user to install the predesigned panels in a modular configuration without much measurement, cutting, or assembly. As such, speed, cost, and efficiency of installation is largely increased whereas error and waste are largely decreased. Moreover, laying the predesigned panels on the installation surface allows the installer to prepare the installation surface with a uniform and flat layer having good structural integrity. This in turn facilitates a high quality installation of the final finish layer on top of the panels An insulating modular panel may include channels and apertures which are arranged to facilitate installation of the transfer elements and reduce user error when installing. In addition, the panels protect the transfer elements and reduce the risk of damaging the elements during installation or in subsequent replacement or repairs. Furthermore, an insulating modular panel may comprise a material with a thermal resistance value or an R-Value inherent in its composition which function as an effective thermal insulator.

The insulating modular panel may be configured to receive a heat transfer element or energy transfer element while maintaining a generally planar surface. The generally planar surface facilitates installation on flat surfaces such as on floors or walls of structures. Nevertheless, where the surface contour of the installation surface is not flat, the insulating modular panel of the present application may be configured with an alternative surface which facilitates installation. For example, the panels may be especially adapted for installation on curved surfaces by forming the panels with curved surfaces. Moreover, where the installation surface has surface features, such as depressions or protrusions, the panels may be formed with complimentary or mating depressions or protrusions which match the installation surface and facilitate installation. Of course, depending on the design needs of the particular installation, panels with flat or planar surfaces may be installed on non-planar or contoured surfaces as well.

The panel may be molded to the user's dimensional preferences, thereby eliminating common installation errors. The insulating modular panel may also function as an underlayment or insulation layer and can be mechanically fastened to an installation surface. By way of example in flooring applications, the panel may be secured directly to a subfloor to eliminate lifting and shifting.

The panels may be provided with the transfer elements already incorporated into them. In such instances, the transfer elements may be connected to those of an adjacent panel onsite. Accordingly, the elements may include couplings for connection of the transfer elements. Methods and devices for coupling and connecting various types of transfer elements are known to those skilled in the art. Alternatively, the panel can be configured with the channels to receive the transfer element and the transfer element may be installed in the panel at the jobsite. Moreover, the panels may be particularly adapted for insertion or incorporation of a specific transfer element which is off-the-shelf or custom-made, such a wires, tubes, pipes, wire grids, or wire harnesses.

In some embodiments, the panel may be equipped with one or more apertures. Alternatively, the apertures may be eliminated. The apertures may be open-ended to enable adhesive applied to the panel or to a surface of the panel to flow through to the opposing surface and subsequently to the installation surface. Such a configuration is capable of providing vertical structural support for the finished layer when used with the appropriate adhesive.

In addition, the insulating modular panel can readily accept many types of transfer elements. The transfer element may comprise electric wires, hydronic tubes, piping or tubing to carry other heat transfer elements including air, cooling or heating fluid, or other heat transfer media known in the art. As used herein, and unless context dictates otherwise, the term transfer element is intended to include known elements for transferring energy, including heat, including wiring, tubing, piping, including, but not limited to copper wiring, aluminum wiring, steel wiring, metal tubing or piping, including copper piping, steel, brass, or aluminum tubing or piping, plastic or polymeric tubing and piping, including nylon, PEX to name a few. Moreover, multiple types of transfer elements may be incorporated into a panel or a panel can be configured with channels to receive multiple types of transfer elements.

As used in the description herein and throughout the claims that follow, the meaning of "a," "an," and "the" includes plural reference unless the context clearly dictates otherwise. Also, as used in the description herein, the meaning of "in" includes "into" and "on" unless the context clearly dictates otherwise.

The insulating modular panel may be made from any suitable material that accomplishes the goals of the invention. The panels may be constructed from a foam-type material that is insulating. In such a configuration, the foam-type construction provides an insulating barrier which separating the transfer element from the installation surface. Some examples of foam-type materials more fully discussed below. Moreover, other plastic or polymeric materials may be used to construct the panel. Examples of materials which may be used to construct the panel is more fully discussed below. The insulating function prevents heat loss through the installation surface and improves energy efficiency.

The transfer element may be secured in place by any appropriate fastening means with or without adhesive. It may be friction fit. It may be held in place by gravity. It may be coupled in place with the use of mechanical means such as straps, blockades, covering layers, or fasteners. It may be coupled in place with clips, staples, or tie downs. It may be secured in place with adhesive, including self-adhesive mesh tape. It may be secured in place with liquid adhesive polymeric adhesive, epoxy, resin, silicone, self-leveling agent, bonding agents, flooring adhesive, tile adhesive, concrete, mortar, thinset mortar, or fillers.

Additionally, the insulating modular panel is secured to the installation surface by chemical or mechanical means. For example, the panel may be coupled to the installation surface with fasteners, including nails, screws, clips, staples, etc. It may be coupled to the installation surface with adhesive materials such as those listed in the paragraph above with respect to the transfer elements or those known in the art. It may also be laid in place and sandwiched between other surfaces which hold it in place.

The insulating modular panel may also be used as an underlayment in installations. Specifically with respect to flooring applications, the panel may be used as underlayment for a finished flooring without the use of a transfer element. In other applications, including floor or wall applications, it may be used as underlayment to insulate the surface, to prepare the surface with an appropriate structural attribute such as rigidity or flatness, or to provide a layer in which internal elements may be embedded. One example of the latter includes embedding wiring or other types of elements in solid surfaces such as concrete walls.

The materials used for the construction for the insulating modular panel may vary and are generally selected based on the application. The material is generally selected to be sufficiently rigid to enabling the installer to measure and cut the insulating modular panel more easily, for example a material with a density of about 0.5 to about 6 lbs. per cubic feet. Another example includes a material with a density of about 2.3-2.7 lbs. per cubic feet. Another example includes foamed polymeric material with a density of 2.3-2.7 lbs. per cubic feet. Although, in applications where the panel is required to be highly flexible and conform to the contour of the installation surface, other materials may be used to affect the desired flexibility.

Non-limiting examples of materials which may be employed in the construction of the panel include, but are not limited to, expanded polypropylene foam, expanded polystyrene foam, ethylene propylene diene monomer, polyvinyl chloride, polyurethane, polyethylene, and high-density polyethylene, or any combination thereof. Moreover, foamed or expanded versions of all polymeric material capable of being produced as expanded or in foam form is also contemplated herein. Natural materials such as cork may also be used.

The panel of the present application may be constructed as a monolith using a single material as noted above. Alternatively, it may be constructed from a combination of two or more of said materials. The construction may combine the materials, incorporate them in the form of a matrix, or may optionally encase the panel body in an exterior layer such as a thermoplastic wrap.

Figure 2A:
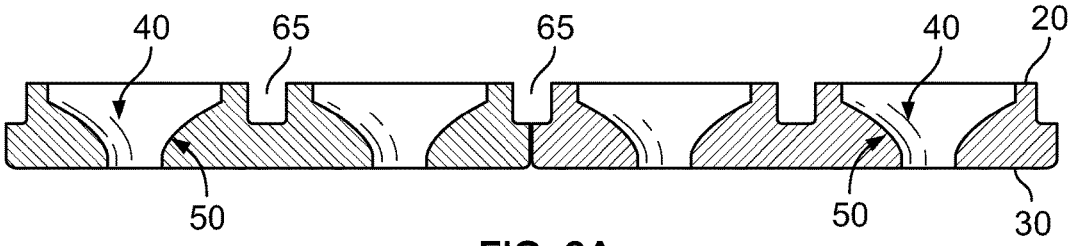
FIG. 2A depicts a cross sectional view of the panel of FIG. 1 along section 2A-2A.
Figure 2B:
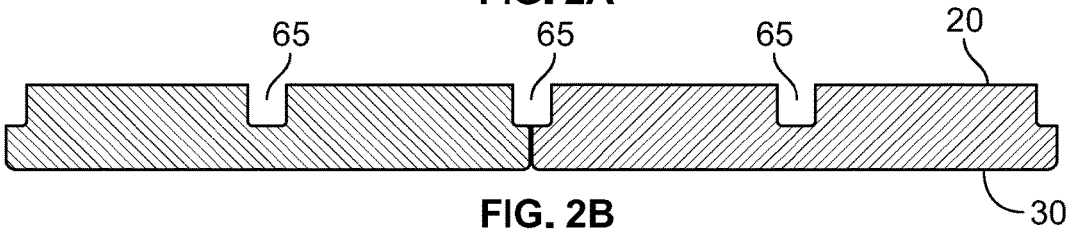
FIG. 2B depicts a cross section view of the panel of FIG. 1 along section 2B-2B.

FIG. 1 shows four insulating modular panels 10 comprises top surface 20, bottom surface 30, plurality of first apertures 40 arranged in a row, and first channels 60 each running perpendicular to second channels 65 (see FIGS. 2A-2B). Alternatively, all four panels shown in FIG. 1 may be integrated as a single panel. That is to say that the size of each panel can be designed as desired and is not limited to the specific configuration shown, with two channels and four apertures.

As is illustrated in other embodiments, the apertures, if incorporated into the panel, need not be arranged in rows and may be asymmetrically configured. Moreover, they may be selectively located, based on the design considerations, to optimize between the desired level of adhesion, the desired rigidity, the amount of materials used, and the custom needs of a particular application.

In one embodiment, insulating modular panel board 10 may be about 6 to about 72 inches in length, about 6 to about 96 inches in width, and about ¼ to about 6 inches in depth. It may be configured to cover an area between about ¼ to about 36 sq. ft. The dimensions of the panel may be adjusted based on the size and type of application to optimize between a number of factors. Some such factors include the expanse of the installation surface, the number of panel units to be used, amount of filler or adhesive material needed, and design flexibility with respect to the layout of the panels. Other design considerations in selecting the size of the panel may include limitations in the manufacturing process. In another embodiment, the insulating modular panel may be 24 inches in length, 36 inches in width, ½ inch in depth, and configured to cover 6 sq. ft.

The dimensions of the channels may be selected based on the particular application, such as what type and size of element will be used in them, or based on the desired structural features of the panel, such as flexibility, rigidity, number of aperture, etc. In the embodiment, shown in FIG. 1, first channels 60 and second channels 65 are greater than ¼ inch and less than ½ inch in depth and about ¼ inch in width. Note that in this embodiment, the channels only extend through a portion of the thickness of the panel.

In one embodiment, the first aperture 40 is about 0.97 inch on top surface 20 and about 0.31 inch on bottom surface 30, and aperture walls 50 are curved (see FIG. 2A). In yet another embodiment, first aperture 40 has a depth equal to the depth of insulating modular panel board 10 and is about ½ to about 1 inch in diameter on top surface 20 and about 1/10 to about ½ inch in diameter on bottom surface 30. In yet another embodiment, insulating modular panel 10 comprises about 384 first apertures 40, about 8 first channels 60, and about 12 second channels 65. In yet another embodiment, panel 10 comprises about 350 to about 410 first apertures 40 positioned parallel to first channels 60 and second channels 65. In yet another embodiment, first channels 60 and second channels 65 comprise a width of about ⅛ to about ¾ inch. In yet other embodiments, the panels may be pre-formed with any of 3", 6", 9" or 12" on-center channel patterns.

The panel shown in FIG. 1 is configured to receive a transfer element within channel 60 or channel 65 (not shown in FIG. 1). Additionally, the channels 60 and 65 in the embodiment of FIG. 1 are offset from the edges of the panel so that the placement of the transfer elements does not fall on a seam between panels.

Figure 3:
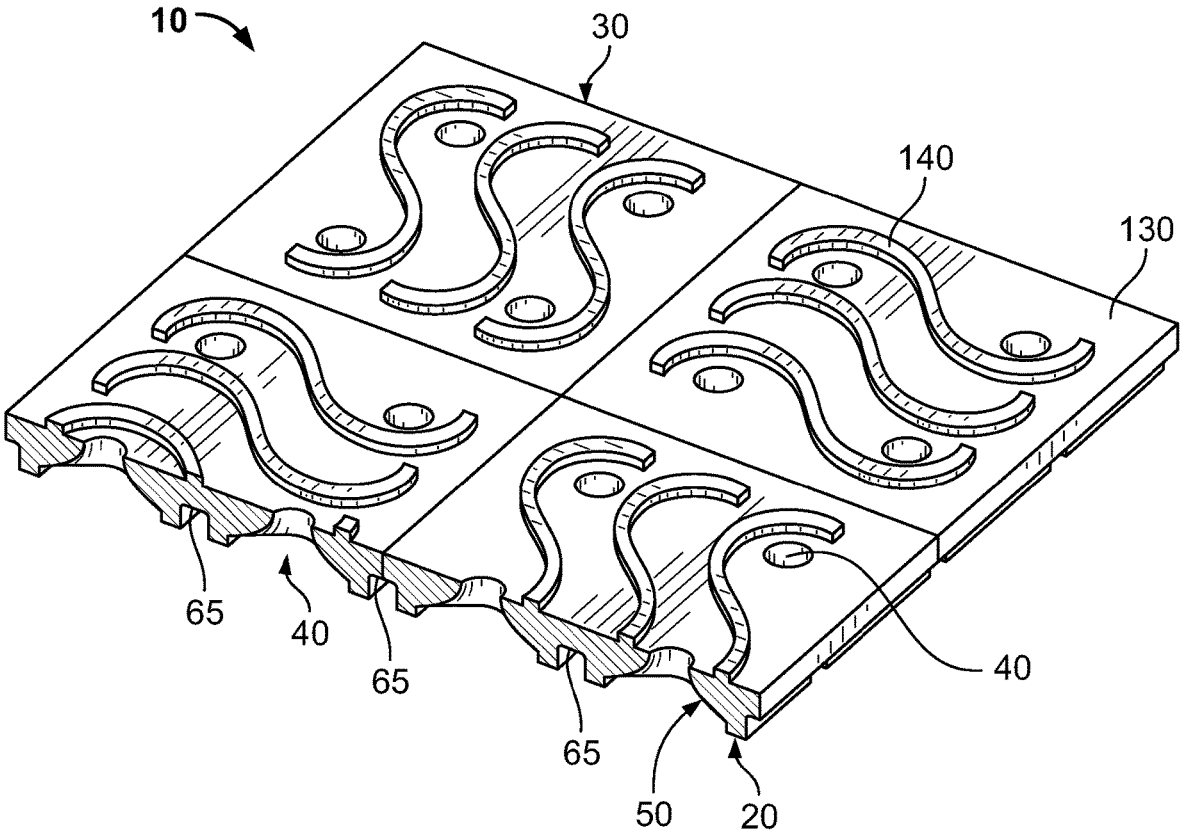
FIG. 3 depicts a configuration of the bottom surface of an embodiment of an insulating modular panel.
Figure 15:
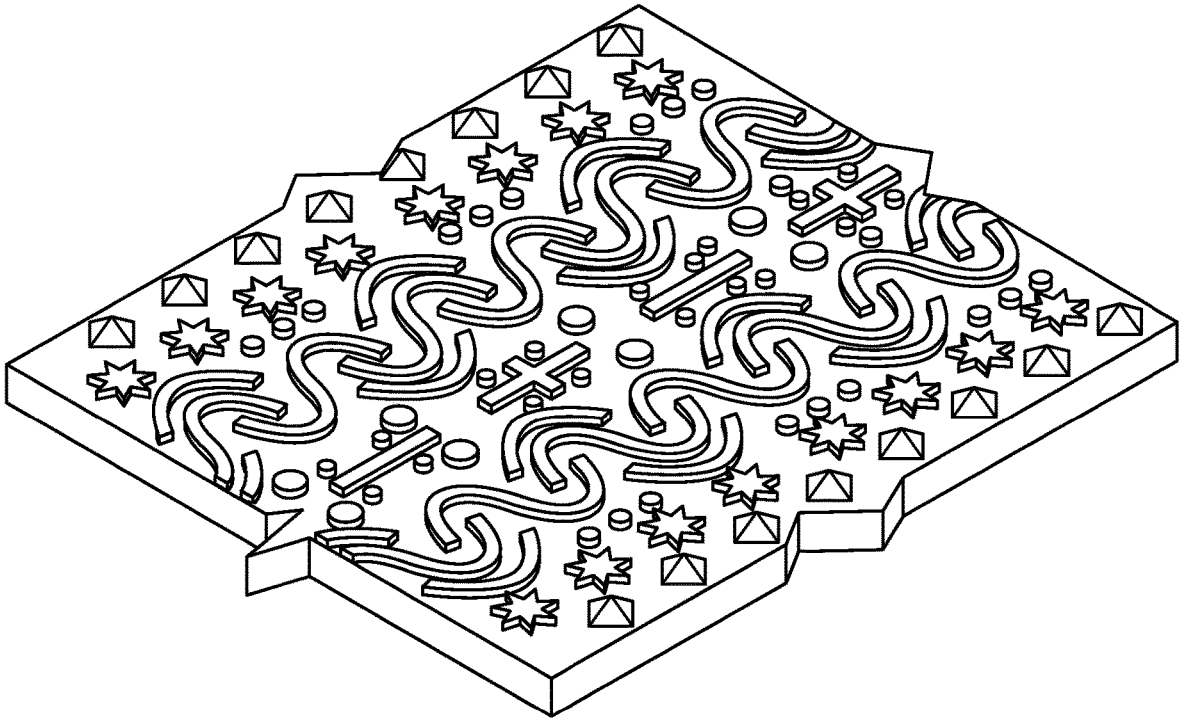
FIG. 15 depicts examples of protrusions and recessions on the bottom surface of an insulating modular panel.

FIG. 3 shows an embodiment of a bottom surface configuration for panel 10. Bottom surface 30 may comprise cavity 130 and a plurality of protrusions 140 extending from bottom surface 30 (see FIG. 3). A plurality of protrusions 140 and a plurality of cavities or recessions 130 may be evenly spaced on bottom surface 30 in the shape of an "S" and curve around plurality of first aperture 40. These S-curves can provide strength in multiple directions and also create a surface feature that aids adhesion. This plurality of protrusions and recessions may take many forms and styles. Some examples of alternative forms and styles are shown in FIG. 15.

Figure 4:
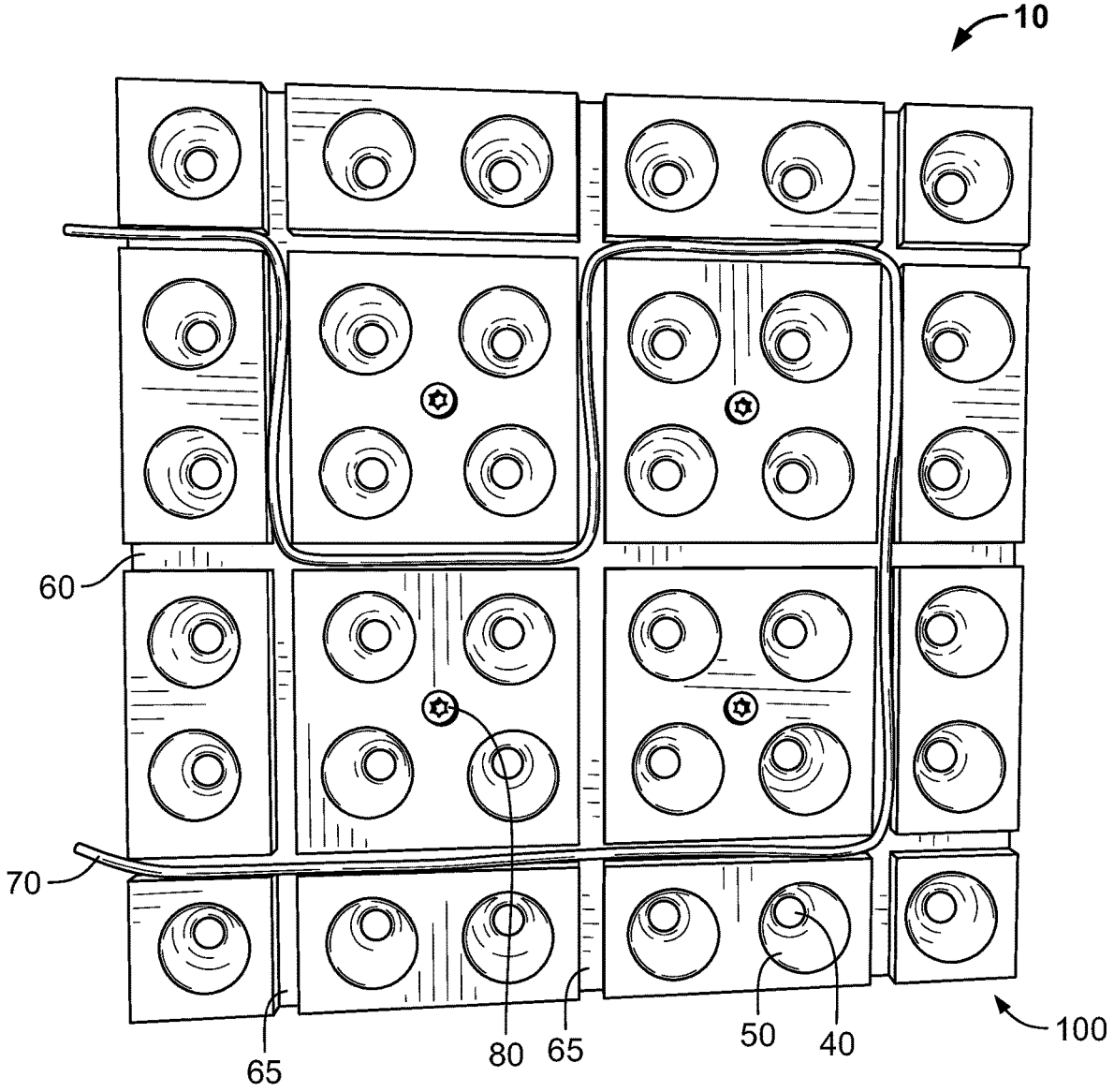
FIG. 4 depicts a top surface view of an embodiment of an insulating modular panel which includes a transfer element arranged in first channels and second channels.

In practice, as shown in the embodiment of FIG. 4, one or more insulating modular panels 10 may be laid out onto an installation surface (surface not shown). The panel may be secured in place on the installation surface (surface not shown). In FIG. 4, fasteners 80 are used to secure the panel to the installation surface. For example, as shown in FIG. 4, one or panels 10 may be laid out on a subfloor and screwed or nailed to the subfloor.

In the embodiment of FIG. 4, the panel 10 is configured with channels to receive transfer elements onsite. Transfer element 70 is routed through first channels 60 and second channels 65. The transfer elements may be placed in all or in some of the channels as needed to affect the desired layout or consistent with manufacturer's recommendations. In FIG. 4, element 70 is routed to create an "S" shape. By way of example, in a flooring application for installing heating elements, the element 70 may be selected to be copper wire for resistive heating and would be routed through the channels with sufficient distance between the wires to prevent overheating.

Figure 5:
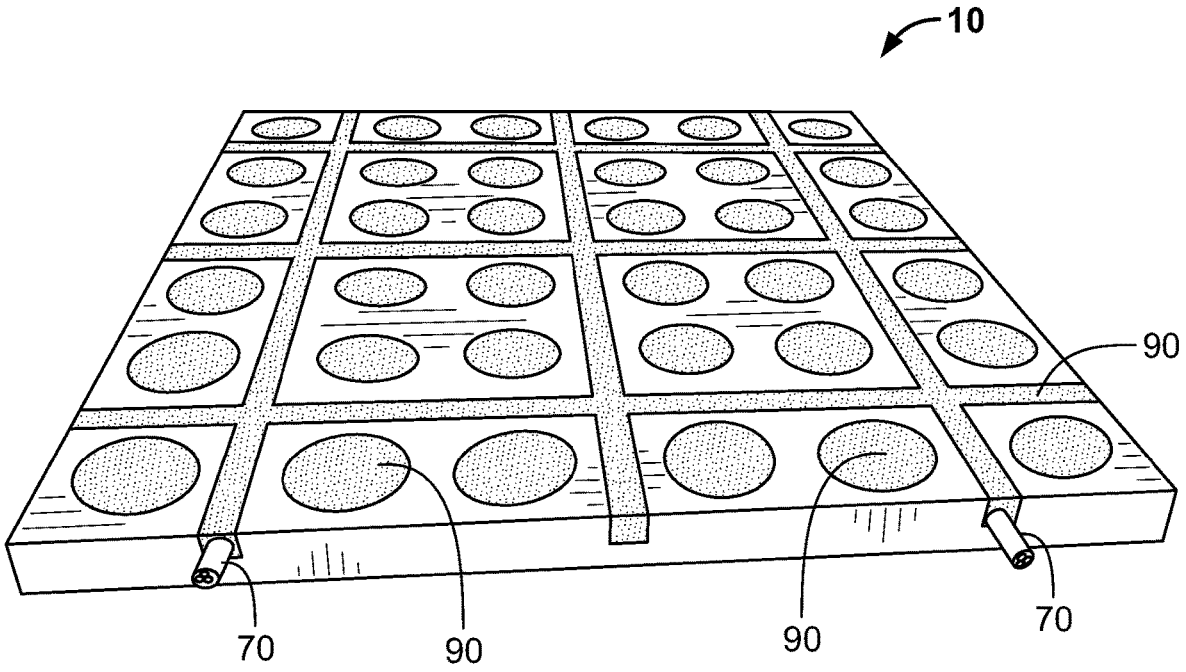
FIG. 5 depicts a top surface view of an embodiment of an insulating modular panel which includes a transfer element with filler.

In certain application, it may be desirable to additionally secure the panels to the installation surface with adhesive. In other applications, it may be desirable to seal the panel. In yet other applications, it may be desirable to impart added rigidity or flexibility to the panel by incorporating rigid or flexible materials. In such applications, as shown in FIG. 5, the apertures and channels may be covered with material that achieves the intended function. For example, in flooring applications, a layer of thinset mortar 90 may be applied to top surface 20 of the panel 10. The mortar 90 saturates first apertures 40, first channels 60, and second channels 65, binds to the subfloor and provides added coupling of the panel to the installation surface. Moreover, the thinset mortar provides adhesion for finished flooring (not shown) to be installed on top of the panel. Further still, inclusion of the thinset mortar also secures the transfer element 70 within the channel. In this embodiment, the transfer element is placed in the channel and secured in place with the thinset mortar, whereas in other applications, the transfer element may be captively placed within the channels as more fully described herein.

Figure 6:
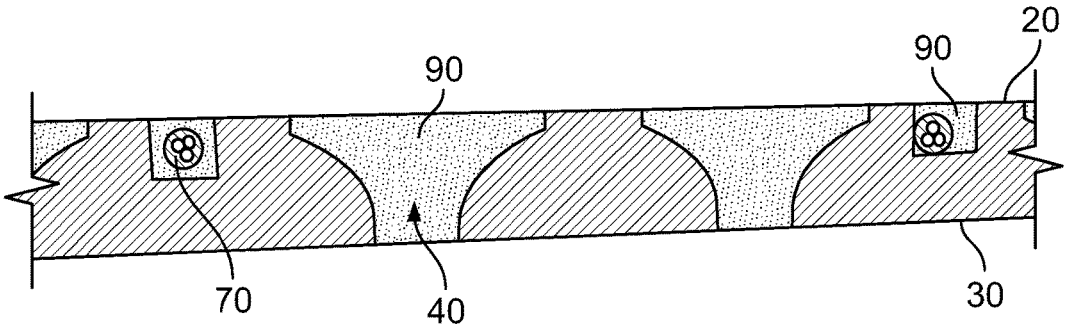
FIG. 6 depicts a cross sectional view of an embodiment of an insulating modular panel which includes a transfer element with filler.

FIG. 6 shows a cross sectional view of the installation of FIG. 5. Note that even though FIGS. 5 and 6 have been specifically described with respect a flooring application using wires and thinset mortar, the present application is not limited so.

As noted above, the channels and apertures may be selected based on the desired attributes of the panel. Generally, panels may be designed to optimize strength, insulation, and minimize the volume of adhesive or filler required. The panels may also be designed to, minimize heat loss or heat transfer through the installation surface. The apertures may be designed to provide optimum support for the finished surface with the least amount of contact with the installation surface to minimize heat loss through the installation surface. Round apertures with tapered walls also reduce the volume of filler or adhesive needed for maximum adhesion. The channels may be designed to optimally hold, captures, or protects the transfer elements. The channel size may be designed to securely hold the transfer element but require a minimum amount of adhesive required to transfer heat. The spacing of the channels may be selected to optimize onsite installation time, and maximize uniformity. Select examples of alternative configurations of apertures and channels are described with respect to FIGS. 7-15.

Figure 7:
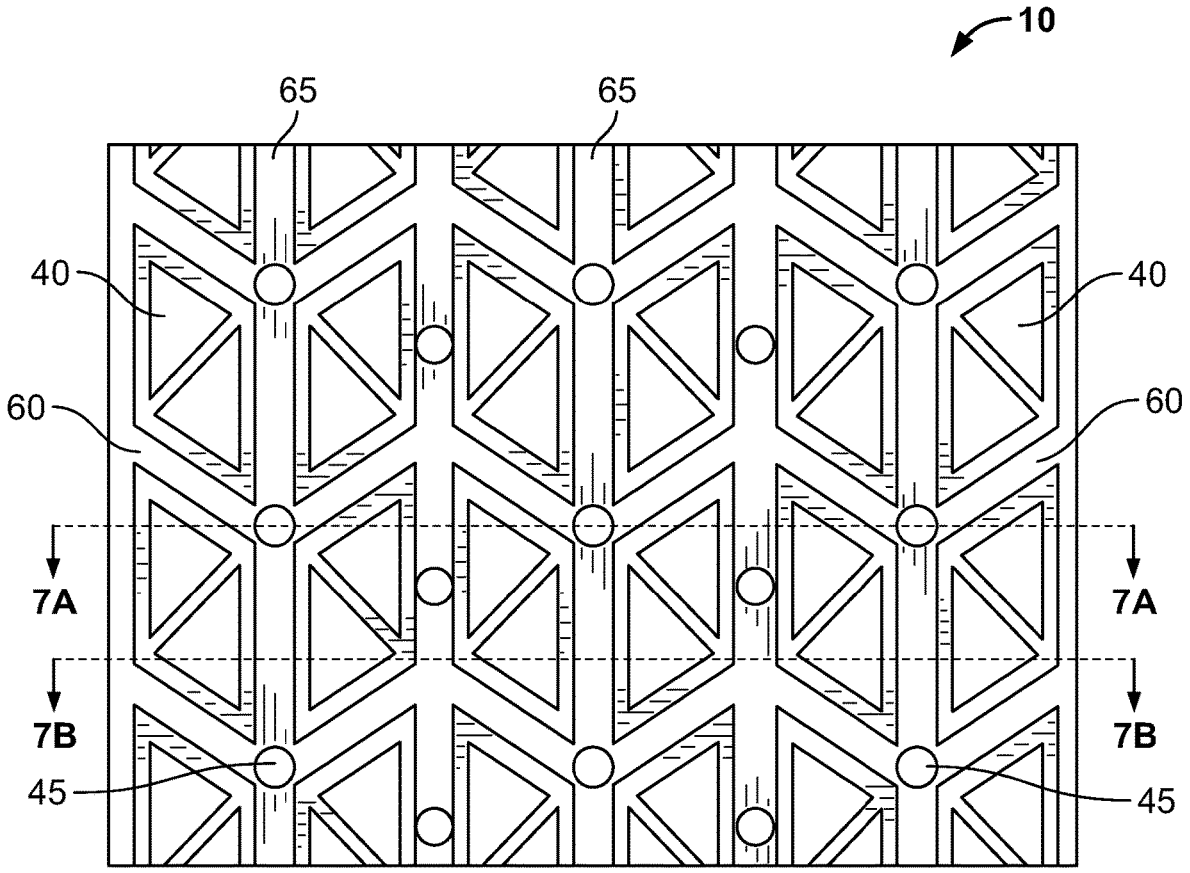
FIG. 7 depicts an embodiment of an insulating modular panel with angled channels.
Figure 7A:
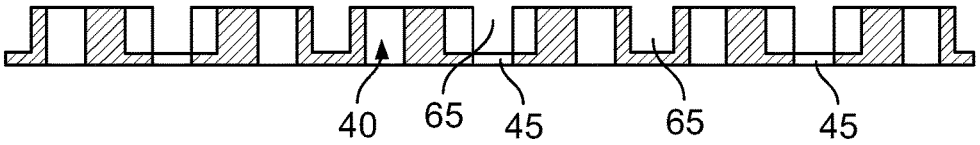
FIG. 7A depicts a cross section view along section 7A-7A of FIG. 7.
Figure 7B:
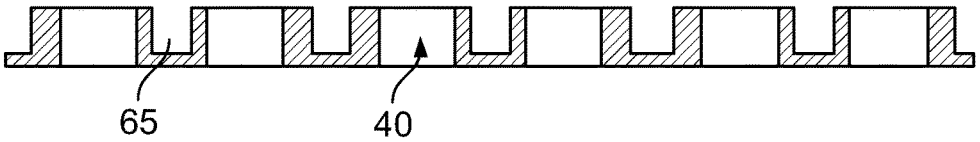
FIG. 7B depicts a cross section view along section 7B-7B of FIG. 7.

In FIGS. 7-7B, the aperture walls 50 are perpendicular to the plane of insulating modular panel 10 and first apertures 40 comprise a triangular shape and second apertures 45 comprise a circular shape. In this embodiment, first channels 60 are positioned at an angle of about 90 degrees with respect to second channels 65. The depth of first channels 60 and second channels 65 is greater than half the depth of insulating modular panel board 10.

Figure 8:
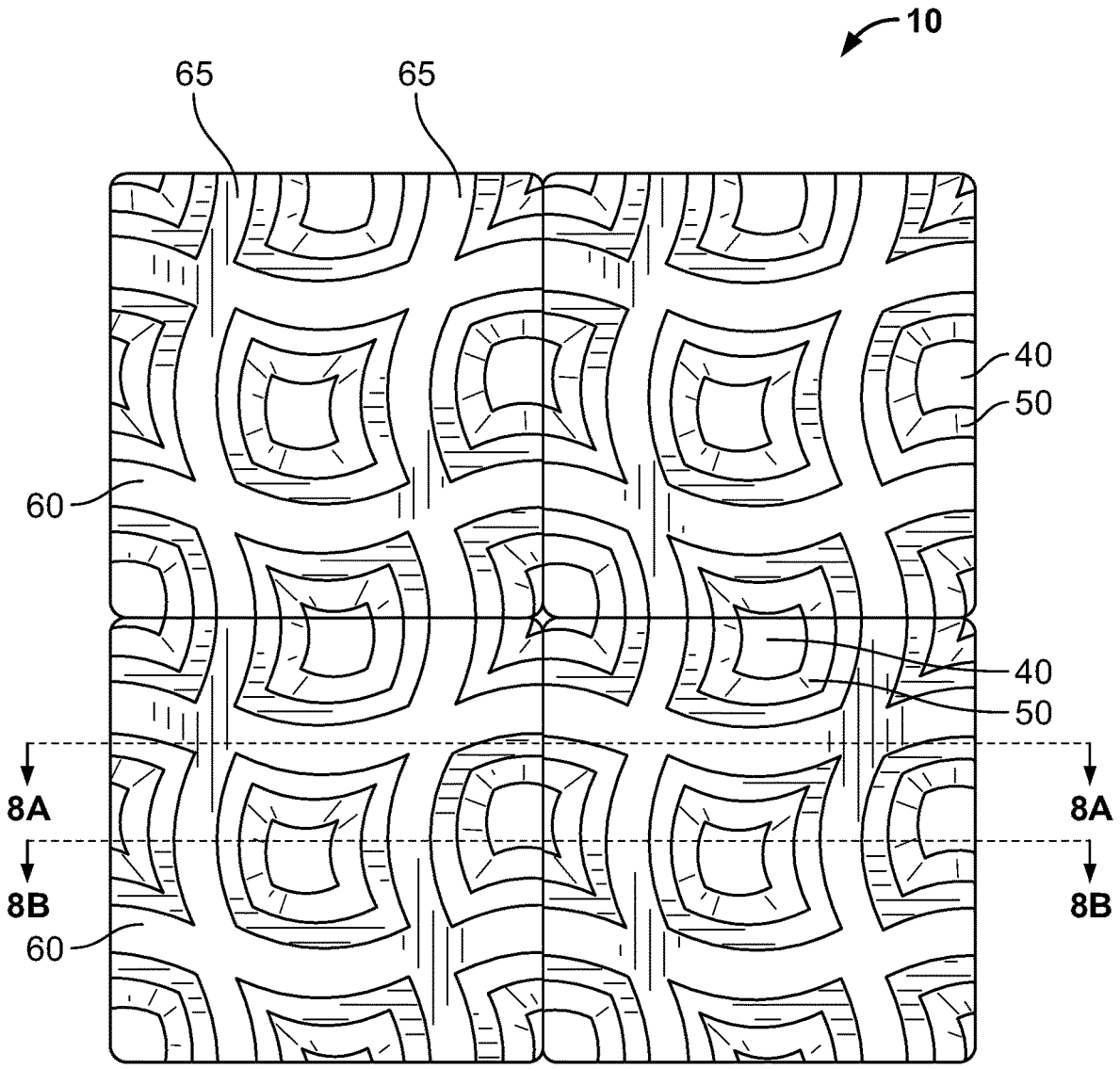
FIG. 8 depicts an embodiment of an insulating modular panel with curved channels.
Figure 8A:
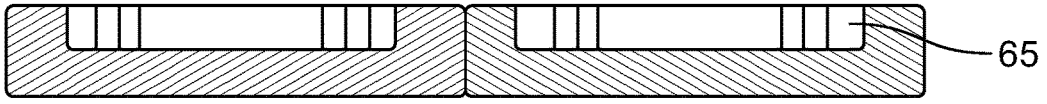
FIG. 8A depicts a cross section view along section 8A-8A of FIG. 8.
Figure 8B:
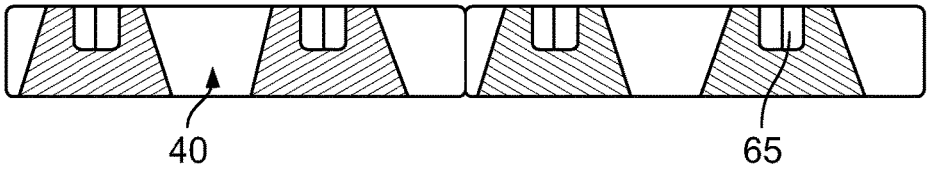
FIG. 8B depicts a cross section view along section 8B-8B of FIG. 8.

In FIGS. 8-8B, aperture walls 50 are angled, first channels 60 and second channels 65 are curved.

Figure 9:
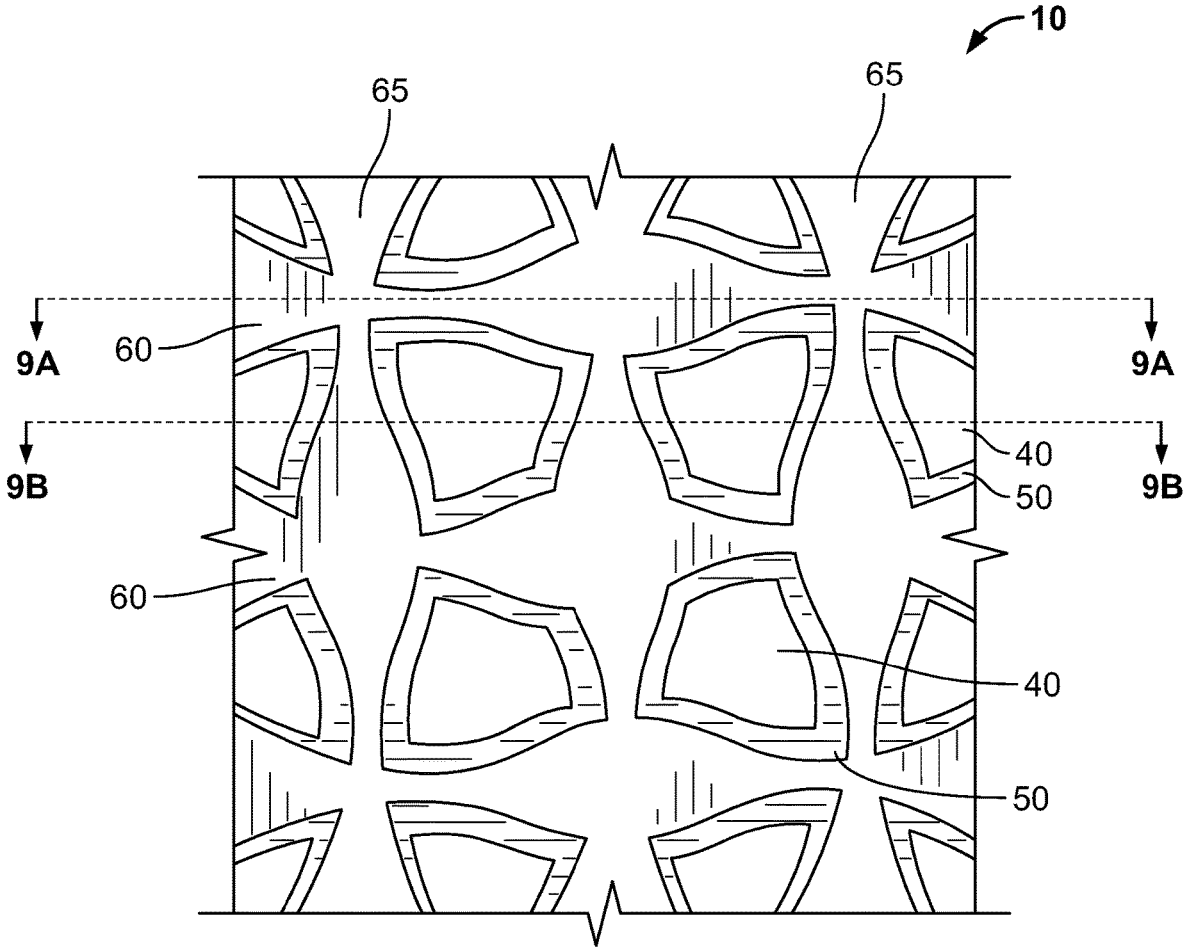
FIG. 9 depicts an embodiment of an insulating modular panel with an asymmetric configuration.
Figure 9A:
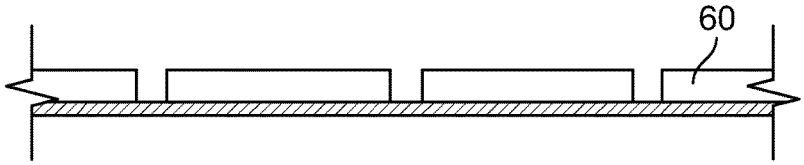
FIG. 9A depicts a cross section view of along section 9A-9A of FIG. 9.
Figure 9B:
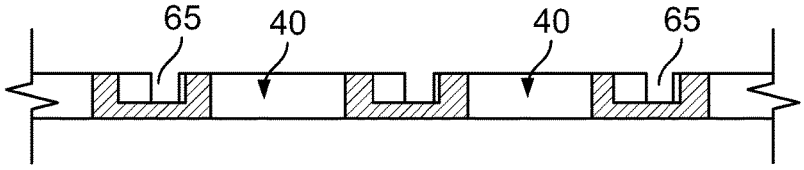
FIG. 9B depicts a cross section view of along section 9B-9B of FIG. 9.

In FIGS. 9-9B, first channels 60 and second channels 65 are uneven and first aperture 40 has four asymmetrical walls. The angle of aperture wall 50 is approximately 70° from the horizontal plane but can be configured for other angles, including between 30° and 90°. In addition, aperture wall 50 may comprise irregular walls which are curved or stepped in shape.

Figure 10:
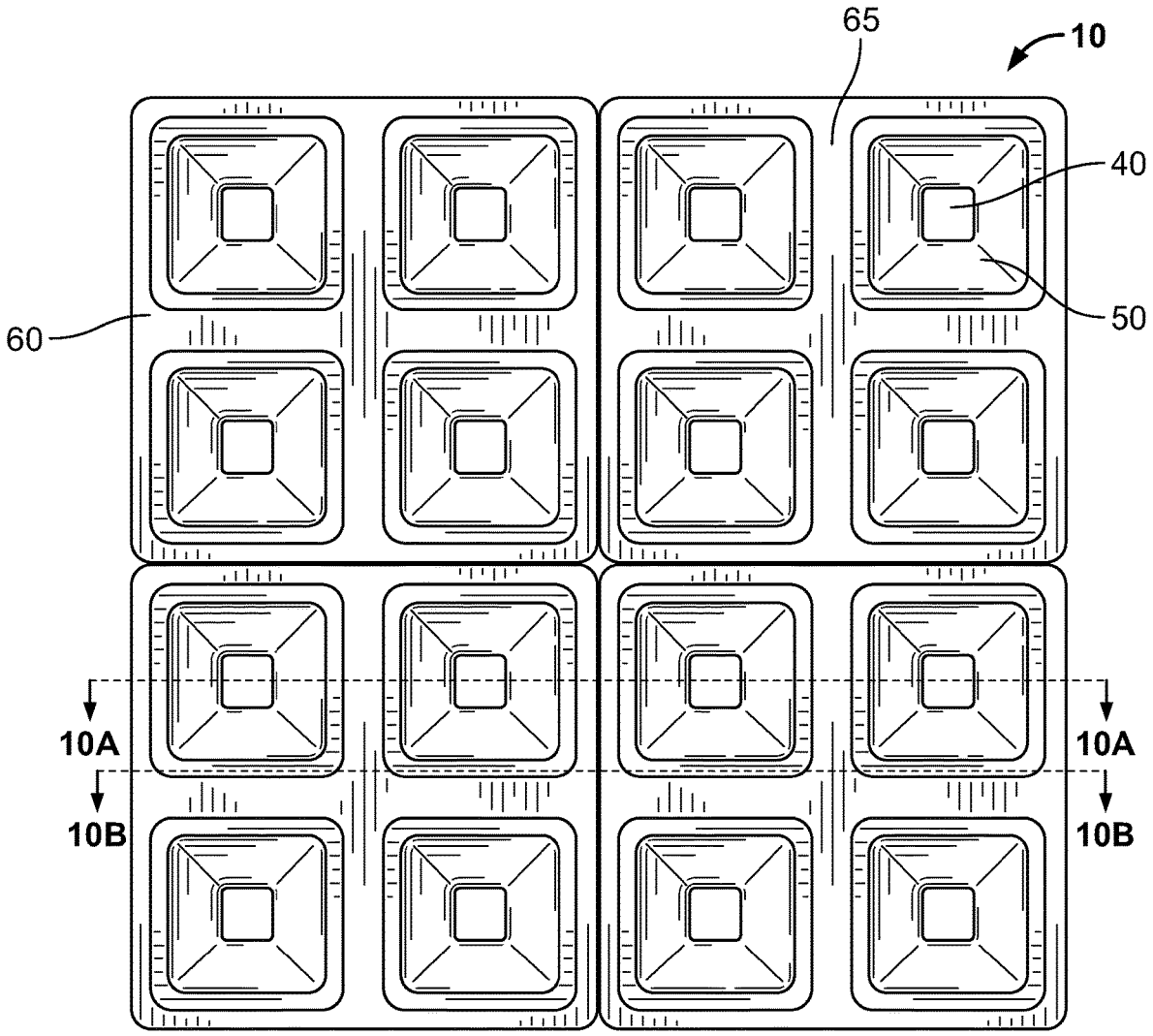
FIG. 10 depicts an embodiment of an insulating modular panel with square apertures.
Figure 10A:
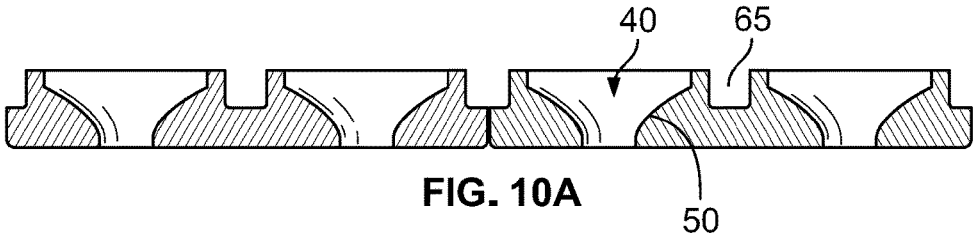
FIG. 10A depicts a cross section along section 10A-10A of FIG. 10.
Figure 10B:
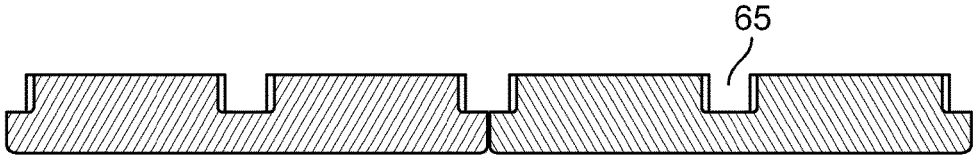
FIG. 10B depicts a cross section view along section 10B-10B of FIG. 10.
Figure 11:
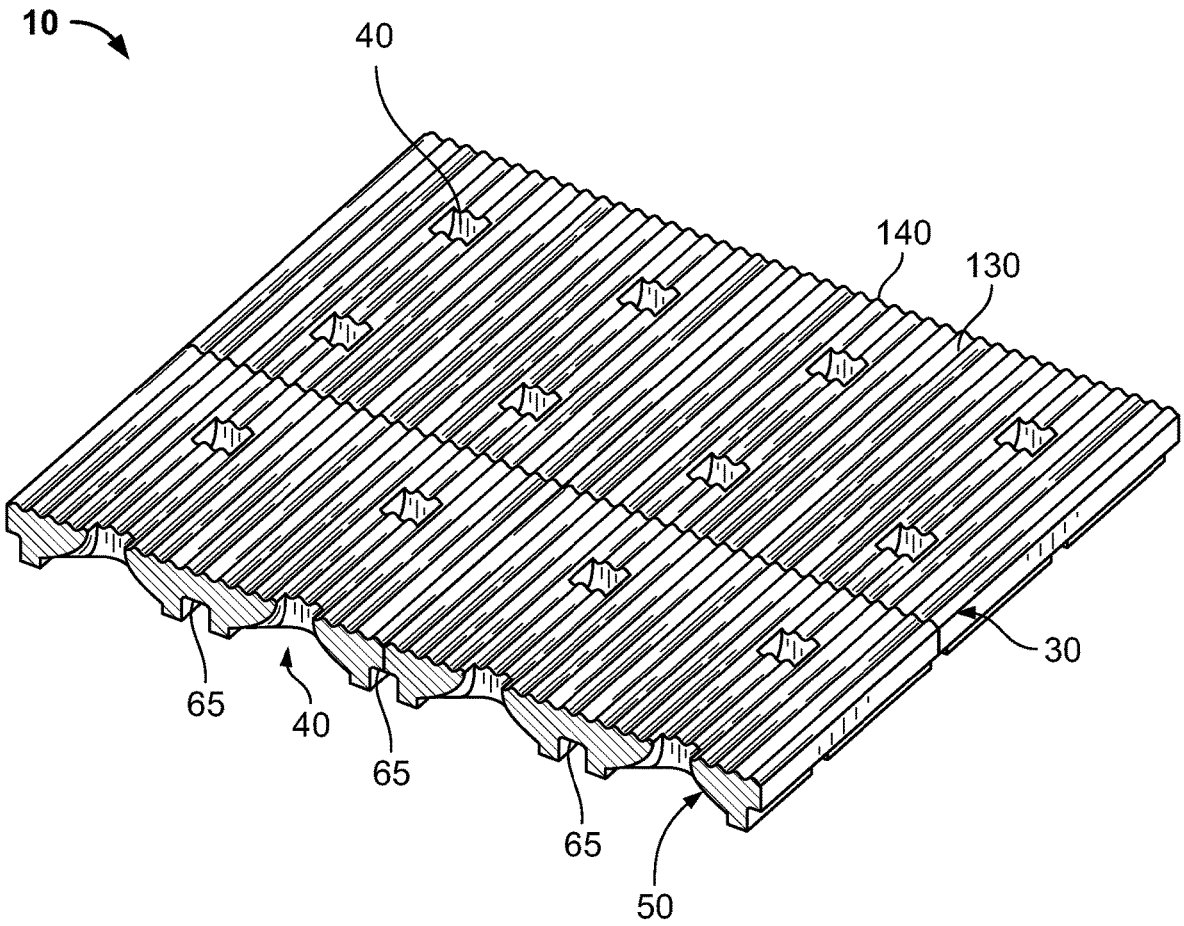
FIG. 11 depicts an embodiment of a bottom surface of an insulating modular panel.

In FIGS. 10-10B, first aperture 40 is square in shape and first channels 60 run perpendicular to second channels 65. In this embodiment, bottom surface 30 comprises a recessed textured surface wherein a plurality of cavities 130 are alternately placed with a plurality of protrusions 140 covering entire bottom surface 30. FIG. 11 illustrates another embodiment protrusions and cavities on the bottom surface of a panel.

Figure 12:
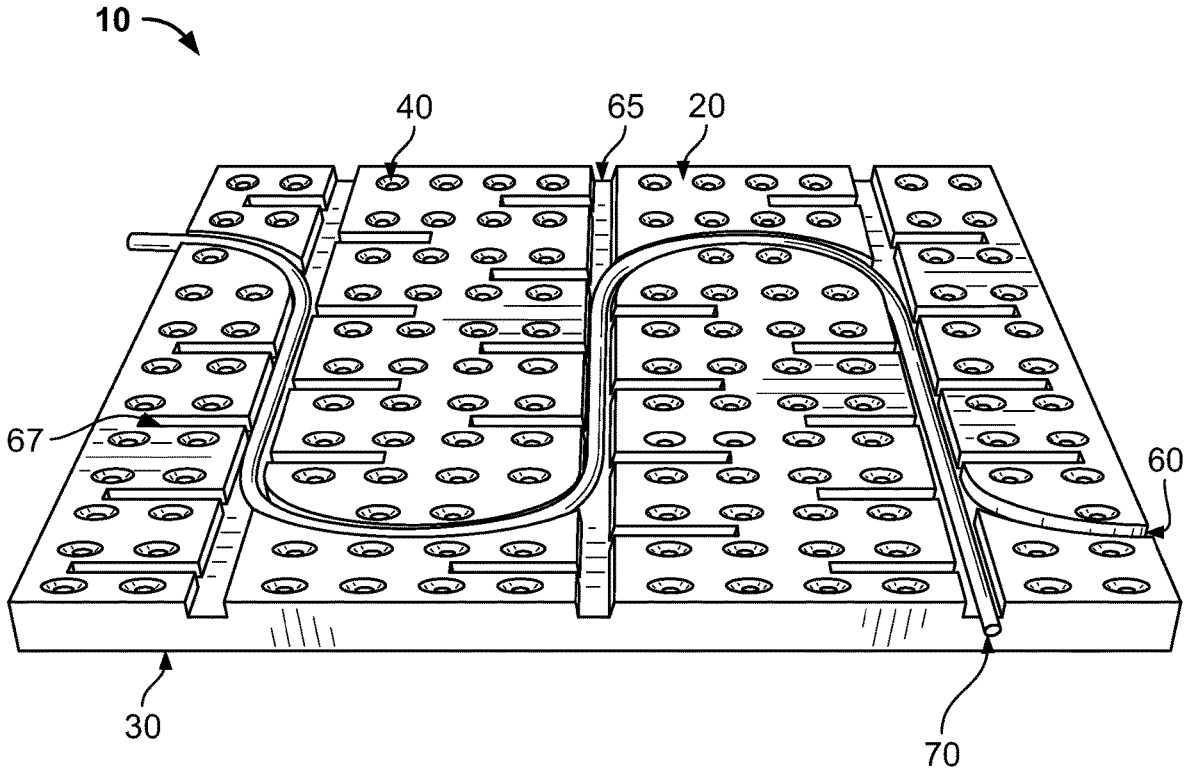
FIG. 12 depicts an embodiment of an insulating modular panel wherein the transfer element is hydronic.

In FIG. 12, insulating modular panel 10 comprises top surface 20, bottom surface 30, first aperture 40, first channel 60, second channel 65, heat disbursement channel 67, and heat transfer element 70. In this embodiment, heat transfer element 70 may comprise a hollow tube to accept heated water. Alternatively, instead of water, any appropriate heat transfer medium may be used. A plurality of second channels 65 are placed at intervals wherein a plurality of first channels 60 are curved in shape and intersect with plurality of second channel 65 at uneven intervals. A plurality of heat disbursement channels 67 are staggered throughout and run perpendicular to plurality of second channel 65. Furthermore, in this configuration, heat disbursement channel 67 disburses the heat away from heat transfer element 70, allowing for distribution of heat on the installation surface. In this embodiment, insulating modular panel board 10 is about 2 by about 3 feet and about 1 inch thick. First channel 60, second channel 65, and heat disbursement channel 67 are about ⅝ inch wide on top surface 20 and do not extend all the way through to bottom surface 30. First Aperture 40 extends from top surface 20 through bottom surface 30. Although the hydronic transfer element is described with respect to FIG. 12, the embodiment of FIG. 12, it may be used with any of the contemplated configurations of the application. Conversely, any of the other transfer elements as contemplated herein may be used in the configuration disclosed in FIG. 12.

Figure 13:
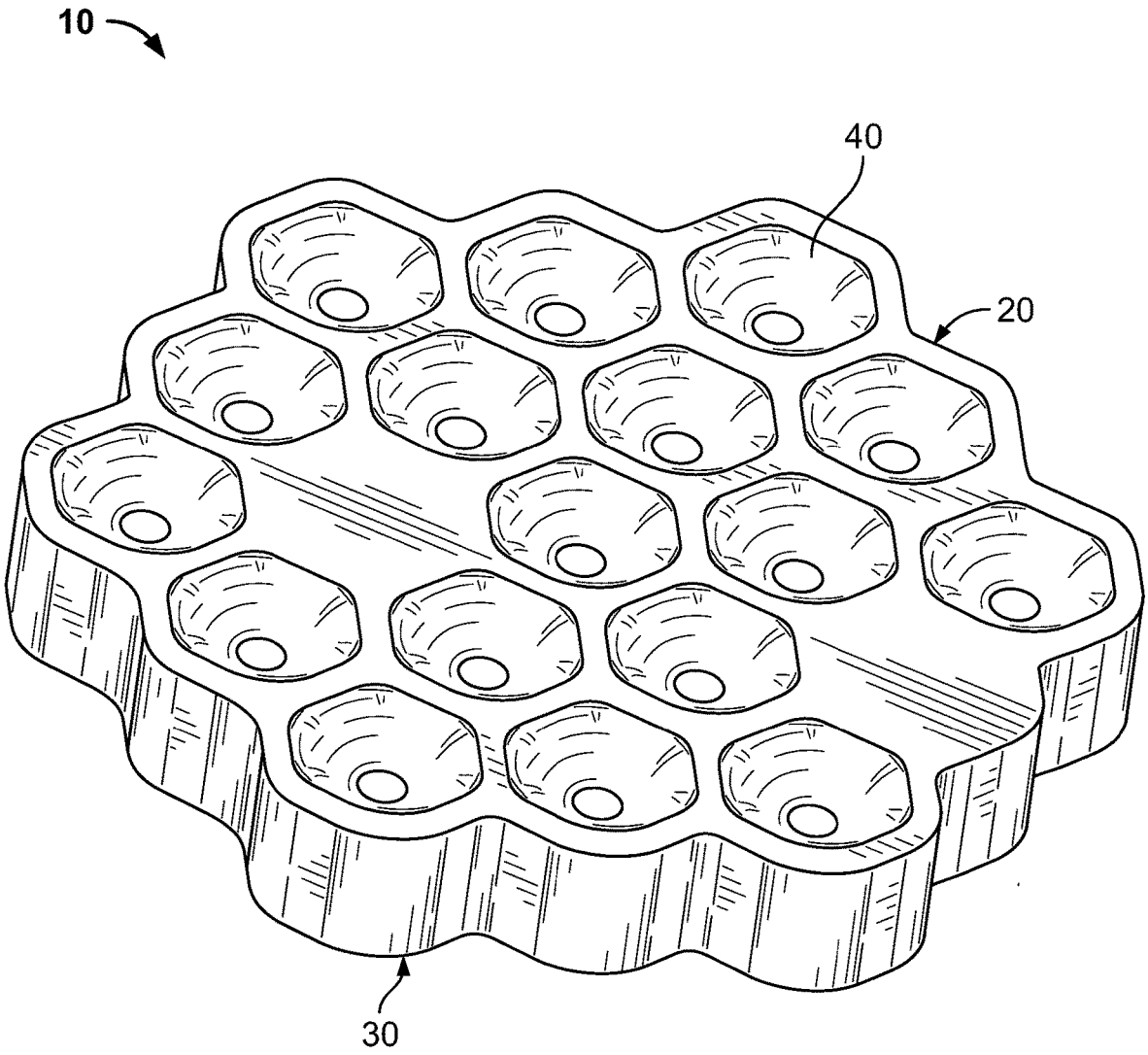
FIG. 13 depicts an embodiment of an insulating modular panel without channels.

In FIG. 13, insulating modular panel 10 comprises top surface 20, bottom surface 30, and a plurality of first apertures 40. First aperture 40 may have a reduced diameter and extends from top surface 20 to bottom surface 30. This configuration further reduces heat conduction through the panel. For example, in a flooring application, this configuration further reduces heat conduction from the flooring material, such as tile to the installation surface, such as the subfloor, thereby reducing heat loss through the floor. In this embodiment, insulating modular panel board 10 may be a honeycomb shape and about ¼ to about 4 inches thick.

Figure 14:
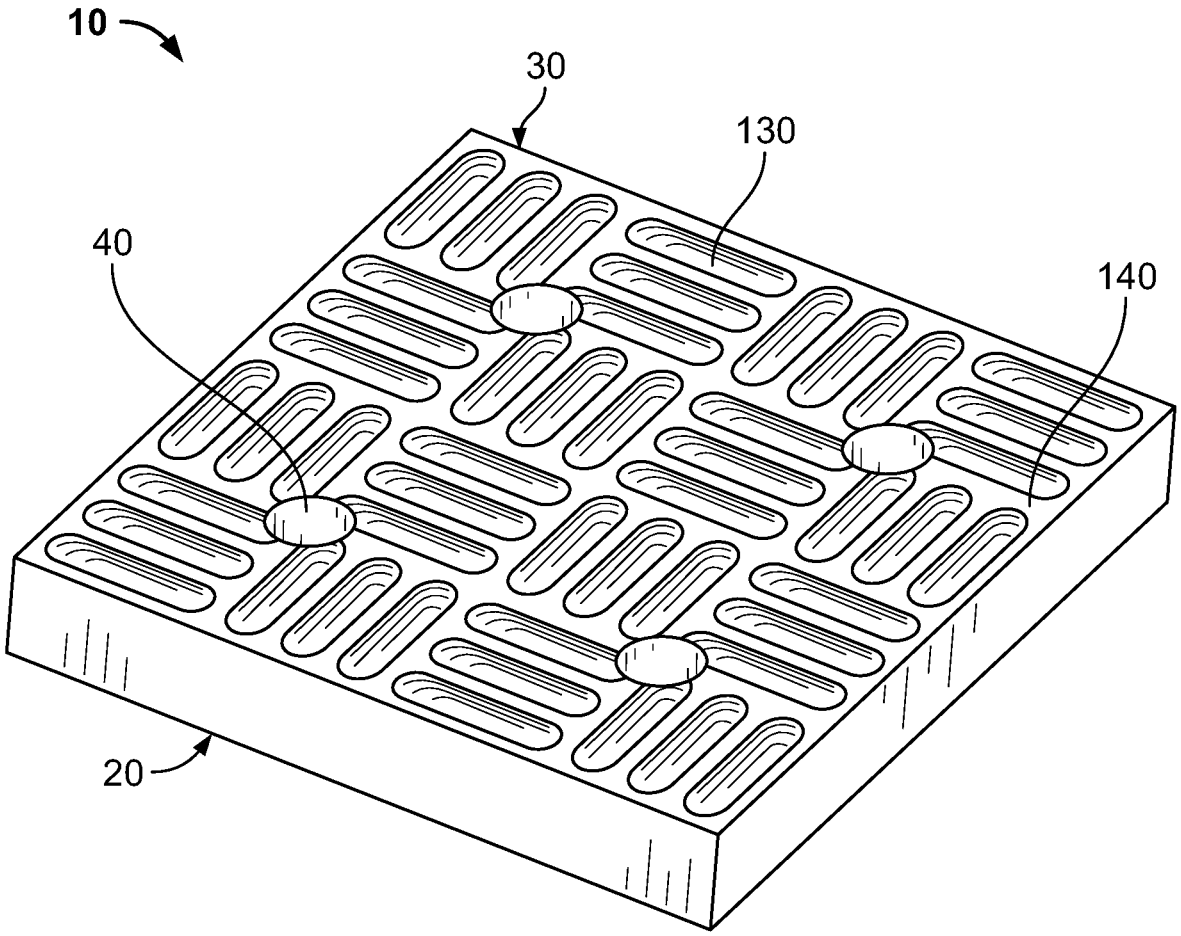
FIG. 14 depicts an embodiment of the bottom surface of an insulating modular panel.

FIG. 14, shows a panel 10 having a bottom surface 30 including a plurality of cavity 130 and a plurality of protrusions 140. In this embodiment, plurality of cavity 130 are oval in shape and facilitate receipt of adhesive. In yet another embodiment, plurality of cavity 130 and plurality of protrusion 140 may be irregular in shape. In an alternate embodiment, bottom surface 30 may comprise multiple different types of shapes of plurality of protrusions 140. It is further contemplated that bottom surface 30 can have any organized or random configuration of cavity 130 or protrusion 140. Protrusions or cavities on bottom surface 30 facilitates adhesion to the installation surface.

As mentioned above, the features of each embodiment may readily be incorporated into another of the embodiments contemplated herein. Any contemplated top surface may be used in combination with any contemplated bottom surface. embodiments. Moreover, any of the sizes, shapes, and configurations contemplated herein may be interchanged between various embodiments.

The present panels and methods have been described using specific examples as illustrated above. But in practice, the features of each may be combined and used in other combinations. Moreover, one or more of the aspects of the invention may be combined together and sold collectively. Moreover, the present invention may be formed into kits which include one or more of the elements of the invention included in a kit and sold. Such kits may be formed with various alternative embodiments so that the user can customize the panels. Moreover, the parts and kits may be formed in ways that permit such customization in situ or without tools. The present invention may be scaled as known in the art, and any corresponding kit may include different sizes of components. In summary, the aspects of the invention described herein can be adjusted and scaled as desirable.

Except as stated above, nothing that has been stated or illustrated is intended or should be interpreted to cause a dedication of any component, step, feature, object, benefit, advantage, or equivalent to the public, regardless of whether it is or is not recited in the claims.

We claim:

1. An insulating modular panel configuration comprising:

i) at least one panel having an edge, a depth adjacent said edge, a width, and a length;

ii) a generally planar top surface formed at a top end of said edge defining the upper most surface of said panel and extending across said width and along said length;

iii) a generally planar bottom surface, formed at a lower end of said edge and generally parallel to said top surface, on said panel for coupling to an installation surface;

iv) at least one channel formed into said depth and extending through said depth from said top surface to near said bottom surface, and extending generally along said width, thereby defining said at least one channel within said depth;

v) at least a second channel formed into said depth and extending through said depth from said top surface to near said bottom surface, and extending generally along said length, thereby defining said at least a second channel within said depth;

where said at least one channel and said at least a second channel are configured to receive an elongated transfer element, said transfer element being used to transfer energy;

wherein said at least one channel and said at least a second channel are open at said generally planar top to receive said elongated transfer element;

wherein the at least one panel is configured to be installed across an installation surface;

wherein the composition of the at least one panel is selected to provide thermal insulation between the installation surface and a top surface of said at least one panel;

wherein the configuration of the at least one panel is selected to provide a secure connection between the installation surface and a top surface of said at least one panel; and wherein the at least one panel is configured for installation on said installation surface as part of a modular system.

2. The configuration of claim 1 wherein the at least one panel is made of a material having a density between 0.5 and 6 lbs. per cubic feet.

3. The configuration of claim 1 wherein said panel comprises expanded polystyrene foam.

4. The configuration of claim 1 further comprising apertures.

5. The configuration of claim 4 wherein the apertures are filled.

6. The configuration of claim 4 wherein the apertures include tapered walls.

7. The configuration of claim 1 further comprising a plurality of said at least one channel.

8. The configuration of claim 1 wherein said plurality of channels are spaced 3 inches or 6 inches or 9 inches or 12 inches on center.

9. The configuration of claim 1 wherein said bottom surface further comprises at least one protrusion or at least one depression.

10. The configuration of claim 1 wherein the installation surface is a subfloor.

11. An insulating modular panel configuration comprising:

i) at least one panel having an edge and a depth adjacent said;

ii) a top surface on said panel, said top surface defining an uppermost surface of said panel;

iii) a bottom surface on said panel for coupling to an installation surface, wherein the bottom surface is spaced from the top surface a distance equal to about said depth;

iv) a plurality of apertures formed in said panel extending from said top surface to near said bottom surface such that the depth of said plurality of apertures is more than 50% of said depth;

wherein said apertures are configured to receive a filler material;

wherein the at least one panel is installed across an installation surface;

wherein the composition of the at least one panel is selected to provide thermal insulation between the installation surface and a top surface of said at least one panel;

wherein the configuration of the at least one panel is selected to provide a secure connection between the installation surface and a top surface of said at least one panel; and wherein the at least one panel is configured for installation on said installation surface as part of a modular system.

12. The configuration of claim 11 wherein the at least one panel is made of a material having a density between 0.5 and 6 lbs. per cubic feet.

13. The configuration of claim 11 wherein the apertures are filled.

14. The configuration of claim 11 wherein the apertures include tapered walls.

15. The configuration of claim 11 wherein the installation surface is a sub-floor.

16. A method of installation comprising the steps of:

i) providing at least one panel having an edge and a depth adjacent said edge; wherein said at least one panel includes an upper most top surface, a bottom surface, generally parallel to and spaced from said top surface, for coupling to an installation surface, and a channel formed in said panel extending from said top surface to near said bottom surface such that the depth of said channel is more than 50% of said depth, and wherein the channel is formed within said depth between the top surface and said bottom surface, where said at least one channel is configured to receive a transfer element adapted for transporting energy;

ii) coupling said at least one panel to said installation surface;

iii) providing a second one of said at least one panel having a channel;

iv) coupling said second panel to said installation surface;

v) placing one or more of said transfer element within the channel of the at least one panel and within the channel the second panel;

wherein the composition of the at least one panel is selected to provide thermal insulation between the installation surface and a top surface of said at least one panel; and wherein the configuration of the at least one panel is selected to provide a secure connection between the installation surface and a top surface of said at least one panel; and wherein the at least one panel is configured for installation on said installation surface as part of a modular system.

17. A method of installation comprising the steps of:

i) providing at least one panel having an edge and a depth adjacent said edge; wherein said at least one panel includes an upper most top surface, a bottom surface, generally parallel to and spaced from said top surface, for coupling to an installation surface, and a plurality of apertures formed in said panel extending from said top surface to near said bottom surface such that the depth of said plurality of apertures is more than 50% of said depth, wherein the plurality of apertures are formed within said depth between the top surface and said bottom surface;

ii) coupling said at least one panel to said installation surface;

iii) providing a second one of said at least one panel having a plurality of apertures;

iv) coupling said second panel to said installation surface;

v) filling said apertures with a filler;

wherein the composition of the at least one panel is selected to provide thermal insulation between the installation surface and a top surface of said at least one panel; and wherein the configuration of the at least one panel is selected to provide a secure connection between the installation surface and a top surface of said at least one panel; and wherein the at least one panel is configured for installation on said installation surface as part of a modular system.

18. A method of using first and second panels configured for installation as part of a modular system comprising the steps of:

i) providing the first panel having an edge and a depth adjacent said edge; wherein said first panel includes an upper most top surface, a bottom surface, generally parallel to and spaced from said top surface, for coupling to an installation surface, and a channel formed in said panel extending from said top surface to near said bottom surface such that the depth of said channel is more than 50% of said depth, wherein the channel is formed within said depth between the top surface and said bottom surface; wherein said channel is configured to receive a transfer element adapted for transporting energy;

ii) coupling said first panel to said installation surface;

iii) providing said second panel having a channel;

iv) coupling said second panel to said installation surface;

v) placing one or more of said transfer element within the channel of the first panel and the channel of the second panel;

wherein the composition of the first and second panels is selected to provide thermal insulation between the installation surface and a top surface of said first and second panels; and wherein the configuration of the at least one panel is selected to provide a secure connection between the installation surface and a top surface of said first and second panels.

* * * * *